US008653345B1

(12) United States Patent
Rogers

(10) Patent No.: US 8,653,345 B1
(45) Date of Patent: Feb. 18, 2014

(54) REPLACEABLE NUT

(76) Inventor: Wayne Rogers, Titusville, FL (US)

( * ) Notice: Subject to any disclaimer, the term of this patent is extended or adjusted under 35 U.S.C. 154(b) by 0 days.

(21) Appl. No.: 13/548,574

(22) Filed: Jul. 13, 2012

Related U.S. Application Data

(60) Provisional application No. 61/507,395, filed on Jul. 13, 2011.

(51) Int. Cl.
*G10D 3/06* (2006.01)

(52) U.S. Cl.
USPC ..... 84/314 N

(58) Field of Classification Search
USPC ..... 84/314 N
See application file for complete search history.

(56) References Cited

U.S. PATENT DOCUMENTS 3,515,025 A * 6/1970 Appleton ..... 84/314 N

* cited by examiner

*Primary Examiner* — Jianchun Qin
(74) *Attorney, Agent, or Firm* — Brian S. Steinberger; Law Offices of Brian S. Steinberger, P.A.

(57) ABSTRACT

Devices, apparatus, and methods of using a replaceable nut with built on fret for a stringed instruments, such as for guitars and banjos. The novel combined zero glide nut with fret can be used as a zero glide nut system that can be substituted for the existing standard nuts on stringed instruments. The novel combined zero glide nut with fret eliminates the need for filing and adjusting the slots on the nuts, since strings do not harshly rub against inner sides and do not rub against the bottom of the slots in the nut. Compared to a conventional nut, the zero glide improves tuning stability, playability without string buzz on the fret, does not wear slots as occurs in a conventional nut and is more easily installed than a conventional nut.

13 Claims, 17 Drawing Sheets

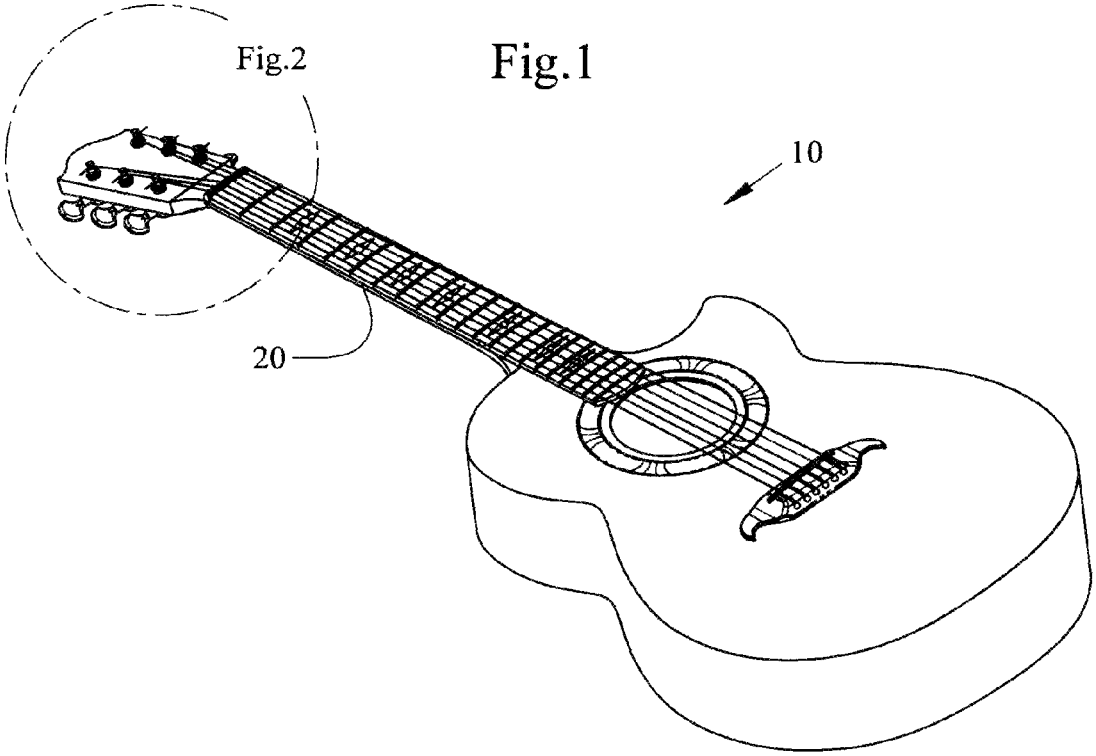
Fig.1
Fig.2
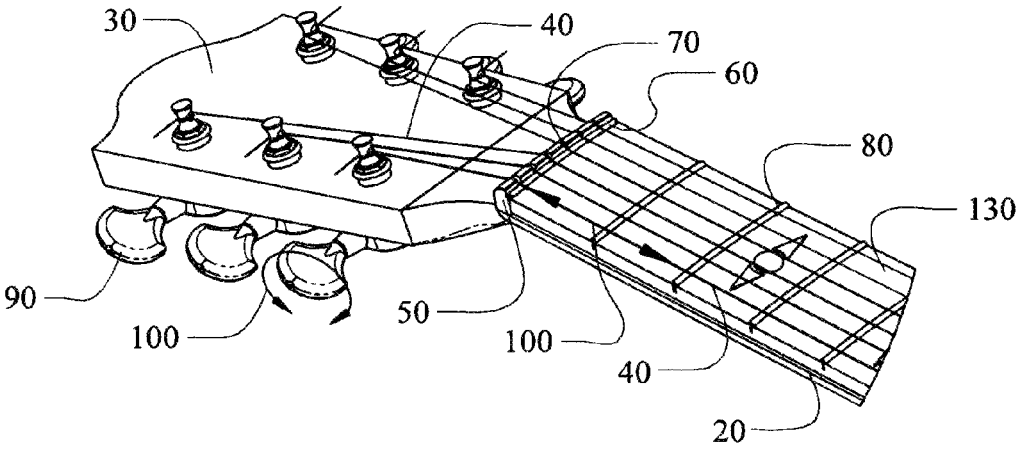

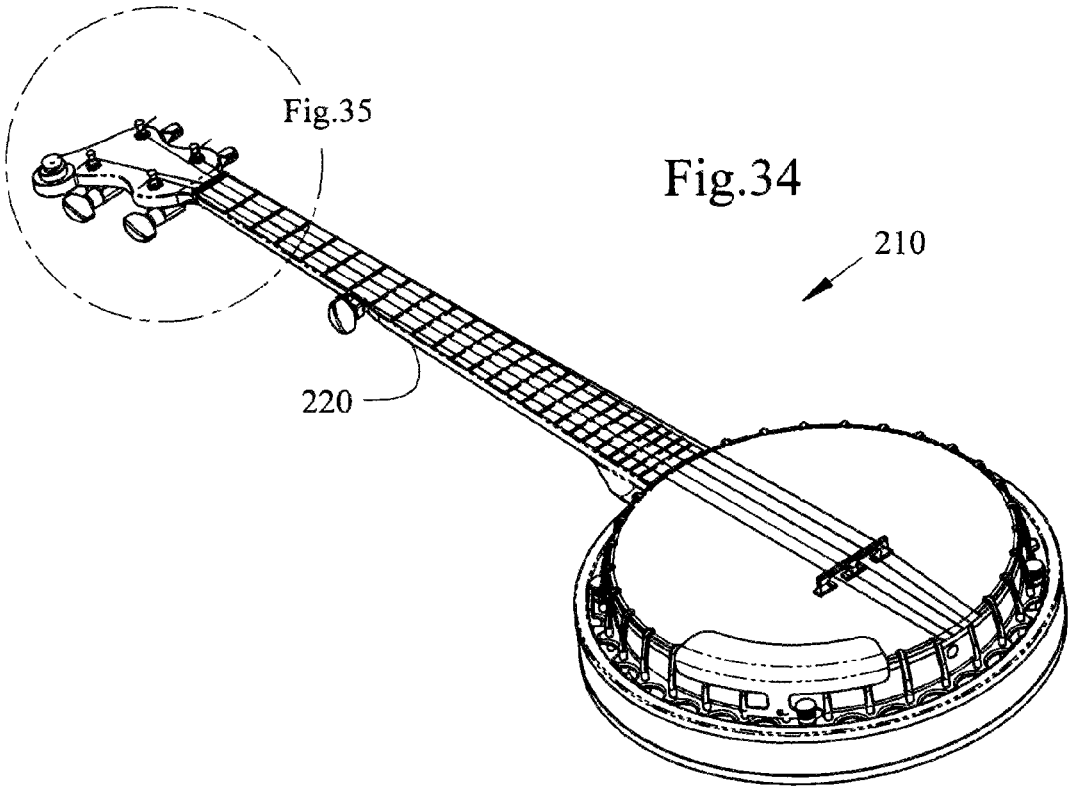
Fig.34
Fig.35
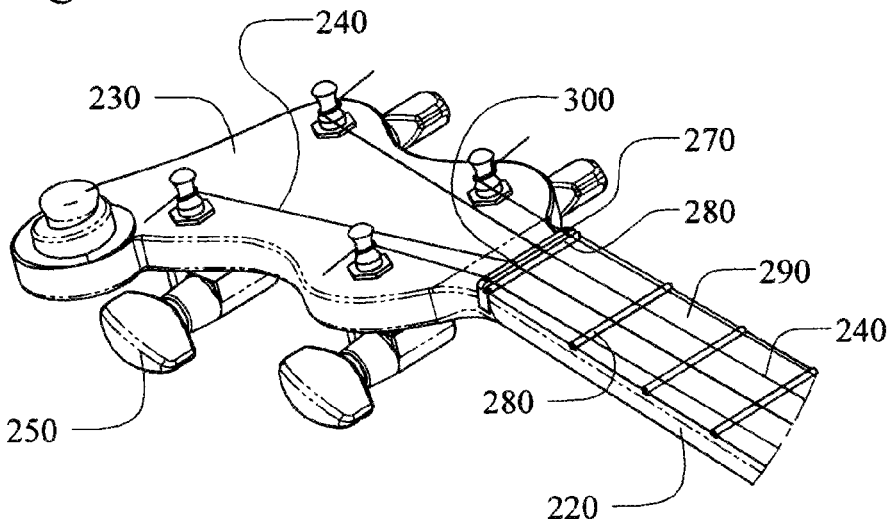

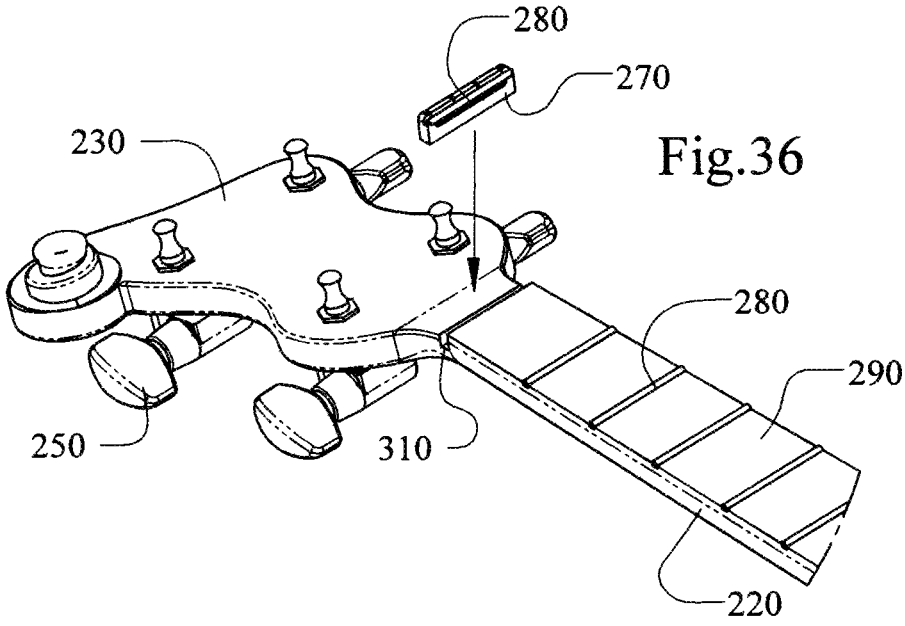
Fig.36
Fig.37
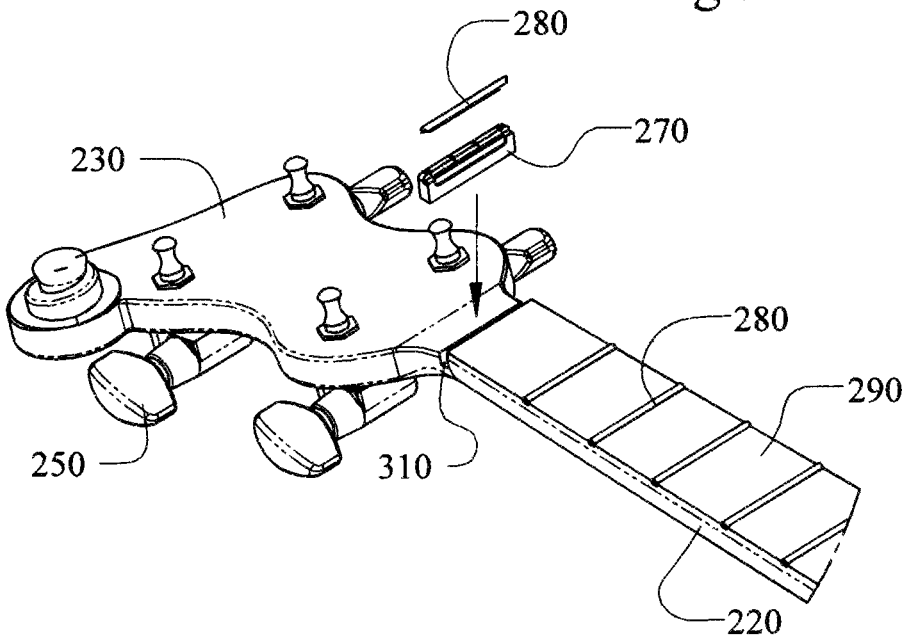

REPLACEABLE NUT

This invention claims the benefit of priority to U.S. Provisional Patent Application Ser. No. 61/507,395 filed Jul. 13, 2011.

FIELD OF INVENTION

This invention relates to stringed instruments, in particular to devices, apparatus, systems, and methods of using and installing a replaceable zero glide nut with built on fret for stringed instruments, such as a guitar and banjo.

BACKGROUND AND PRIOR ART

Guitar necks usually have a plurality of spaced apart frets on the guitar neck and a fixed guitar nut. The nut has a plurality of grooves to allow for strings to sit therein. Frets are the raised portions on the neck of stringed instruments that generally extends across the full width of the neck. Most often the frets are metal strips inserted into the fingerboards on the neck. Frets are generally used to divide the neck into fixed segments at intervals related to a musical framework. On instruments such as guitar, each fret can represents one semitone where one octave is divided into twelve semitones.

The nut of a stringed instrument is a small piece of hard material which supports the strings at the end closest to the headstock. The nut marks one end of the speaking length of each open string, sets the spacing of the strings across the neck, and usually holds the strings at the proper height from the fingerboard. Along with the bridge the nut defines the vibrating lengths (scale lengths) of the open strings. The nut can be made of ebony, ivory, cow bone, brass, Corian or plastic, and is usually notched or grooved for the strings. The grooves are designed to lead the string from the bridge to the headstock so separate the strings and to provide a proper break angle for correct string vibration.

Most prior art stringed instruments, such as guitars have a single nut, and then have a plurality of frets, the first of which is spaced apart from the nut. The single nut can only be replaced with another single nut. To make a proper nut requires that each string notch be carefully cut to the proper depth so that the string is neither too high, affecting overall string height and intonation of fretted notes, nor too low which causes a plucked or picked string to buzz against the frets.

Some guitars and mandolins have nuts that are just string spacers, with deep notches. These instruments use a zero fret, which is a fret at the beginning of the scale where a normal nut would be, which is higher than the other frets to provide the correct string clearance. The zero fret is often found on cheaper instruments, as it's much easier to set up an instrument this way. With a zero fret, the fret merely needs to be the right height. However, a zero fret also makes the sound of the open string very similar to the fretted note, where the nut itself, being made of a different material, has a different timbre if it is used instead of a zero fret. Zero frets are fixed into the neck and are not easily removable.

The prior art has problems with tuning and sound quality when just using nuts since the strings may have friction by resting on the inner sides and bottom of the nut slots. There is no easy way of tuning the slots on the nuts when used by themselves.

None of the prior art allows for a combined nut with fret that can be used to replace a single nut on the stringed instrument.

Thus, the need exists for solutions to the above problems with the prior art.

SUMMARY OF THE INVENTION

A primary objective of the present invention is to provide devices, apparatus, systems and methods of using a combined nut with fret that can be used as a replaceable nut for stringed instruments such as guitars and banjos.

A secondary objective of the present invention is to provide devices, apparatus, systems and methods of using a combined nut with fret on stringed instruments where there is no adjustment necessary for the nut slots.

A third objective of the present invention is to provide devices, apparatus, systems and methods of using a combined nut with fret on stringed instruments, so that when strings vibrate instead of coming off the nut, it will vibrate off the metal fret increasing sound quality.

A fourth objective of the present invention is to provide devices, apparatus, systems and methods of using a combined nut with fret on stringed instruments, so that for tuning, there is less friction on the inner side of the nut slots.

A fifth objective of the present invention is to provide devices, apparatus, systems and methods of using a combined nut with fret on stringed instruments, so that the slots are deep enough so that the bottom of the slots is spaced under the stings, where the bottom of the slots does not rub against the strings.

A sixth objective of the present invention is to provide devices, apparatus, systems and methods of using a combined nut with fret on stringed instruments, which reduce nut friction by up to 93% increasing tuning stability, playability and open string tone.

A seventh objective of the present invention is to provide devices, apparatus, systems and methods of using a combined nut with fret on stringed instruments, which can be installed in minutes with no permanent alteration to the stringed instrument.

A zero glide nut system for stringed instruments, can include the combination of a zero glide nut having a front and a back, and a fret installed on the front of the nut, wherein the combined nut with installed nut, can be used to replace a standard nut on a stringed instrument.

The stringed instrument can be a guitar. The stringed instrument can be a banjo.

The zero glide nut can include a generally convex curved upper front edge. The zero glide nut can include a plurality of spaced apart string slots along a top of the nut.

The zero glide nut can include a indentation in an upper front edge of the nut, wherein the fret is installed into the indentation in the upper front edge of the nut. The indentation can include a two step cut-out in the upper front edge of the nut.

The zero glide nut system can include an adhesive for permanently mounting the fret to the nut.

A novel method of replacing a nut on a stringed instrument with a zero glide nut, can include the steps of providing a stringed instrument with a neck having a standard installed nut, and a plurality of frets, each of which is spaced apart from the nut, providing a zero glide nut with an installed fret, and replacing the standard installed nut on the stringed instrument with the zero glide nut with installed fret.

The zero glide nut with installed fret can include a generally convex curved upper front edge on the nut. The zero glide nut with installed fret can include a plurality of spaced apart string slots along a top of the nut.

The zero glide nut with installed fret can include a indentation in an upper back edge of the nut, wherein the fret is installed into the indentation in the upper back edge of the nut. The indentation can include a two step cut-out in the upper back edge of the nut.

The zero glide nut with installed fret can include an adhesive for permanently mounting the fret to the nut.

The method of claim 9, can include providing a guitar as the stringed instrument. The method of claim 9, can include providing a banjo as the stringed instrument.

Further objects and advantages of this invention will be apparent from the following detailed description of the presently preferred embodiments which are illustrated schematically in the accompanying drawings.

BRIEF DESCRIPTION OF THE FIGURES

FIG. 1 is a top perspective view of a guitar with the zero glide nut installed.

FIG. 2 is an enlarged view of the zero glide nut guitar installation of FIG. 1.

FIG. 34 is a top perspective view of a banjo with the novel zero glide installed. This installation includes an option feature which hides the ends of the fret tang.

FIG. 35 is an enlarged view of the zero glide nut banjo installation of FIG. 34.

FIG. 36 is an exploded view of the zero glide nut and fret and banjo of FIG. 35.

FIG. 37 is another exploded view of zero glide nut and fret and banjo of FIG. 36.

DESCRIPTION OF THE PREFERRED EMBODIMENTS

Before explaining the disclosed embodiments of the present invention in detail it is to be understood that the invention is not limited in its applications to the details of the particular arrangements shown since the invention is capable of other embodiments. Also, the terminology used herein is for the purpose of description and not of limitation.

A description of each of the components will now be described.

10 Guitar.
20 Guitar neck.
21. Guitar neck edge adjacent to cut out 120.
30 Guitar head.
40 Guitar string.
50 Zero Glide nut for guitar.
60 Zero Glide fret for guitar.
70 String slot in guitar nut.
80 Guitar fret.
90 Guitar tuner.
100 String motion resulting from tuner rotation.
110 Standard guitar nut.
120 Nut slot cut out of guitar neck.
130 Guitar fingerboard.
140 Relief cut on Zero Glide guitar nut for Zero Glide fret head clearance.
150 Relief cut on Zero Glide guitar nut for Zero Glide fret tang clearance.
160 Fret head on Zero Glide guitar fret.
170 Fret tang on Zero Glide guitar fret.
180 Standard guitar nut string slot wears as a result of string motion imparted when tuning and
playing.
190 Contact point between Zero Glide fret and string.
200 Worn string slot binds string.
210 Banjo.
220 Banjo neck.
221 Banjo neck edge adjacent to cut out 310
230 Banjo head.
240 Banjo string.
250 Banjo tuner.
260 Standard banjo nut.
270 Zero Glide banjo nut.
280 Zero Glide banjo fret.
290 Banjo fingerboard.
300 Banjo string slot in nut.
310 Nut slot cut out of banjo neck.
320 Relief nut on Zero Glide banjo nut to clear Zero Glide fret head.
330 Blind relief cut on Zero Glide banjo nut to clear fret tang and hide ends of tang.
340 Zero Glide banjo fret head.
350 Zero Glide Banjo fret tang.
360 Zero Glide fret tang cut back from ends to conceal in blind nut relief.
370 Bottom of Zero Glide string slot.

Guitar Installation

Figure 3:
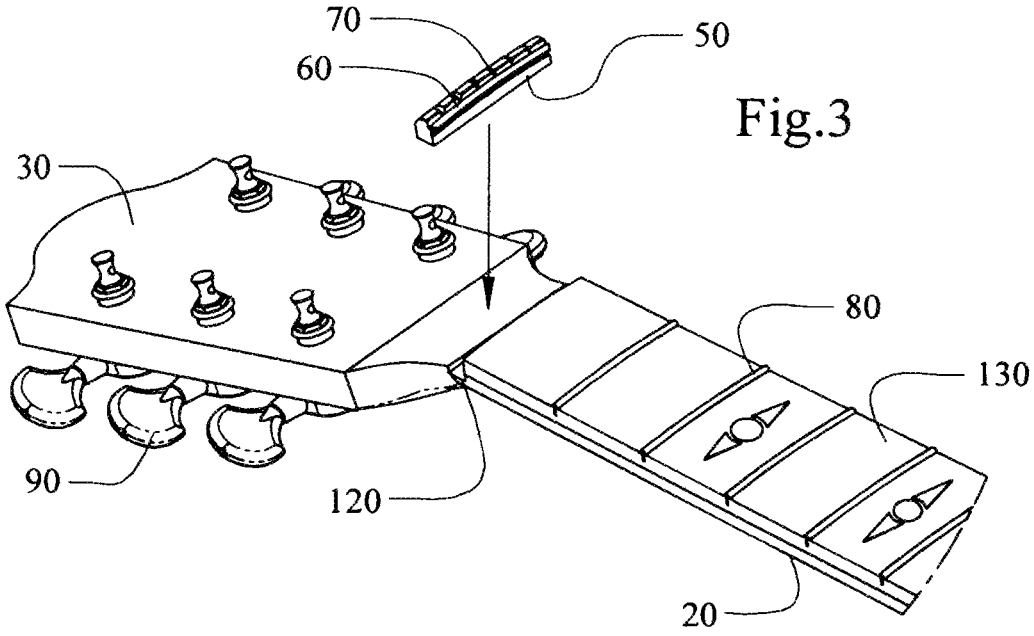
FIG. 3 is an exploded view of the zero glide nut components of FIG. 2.
Figure 4:
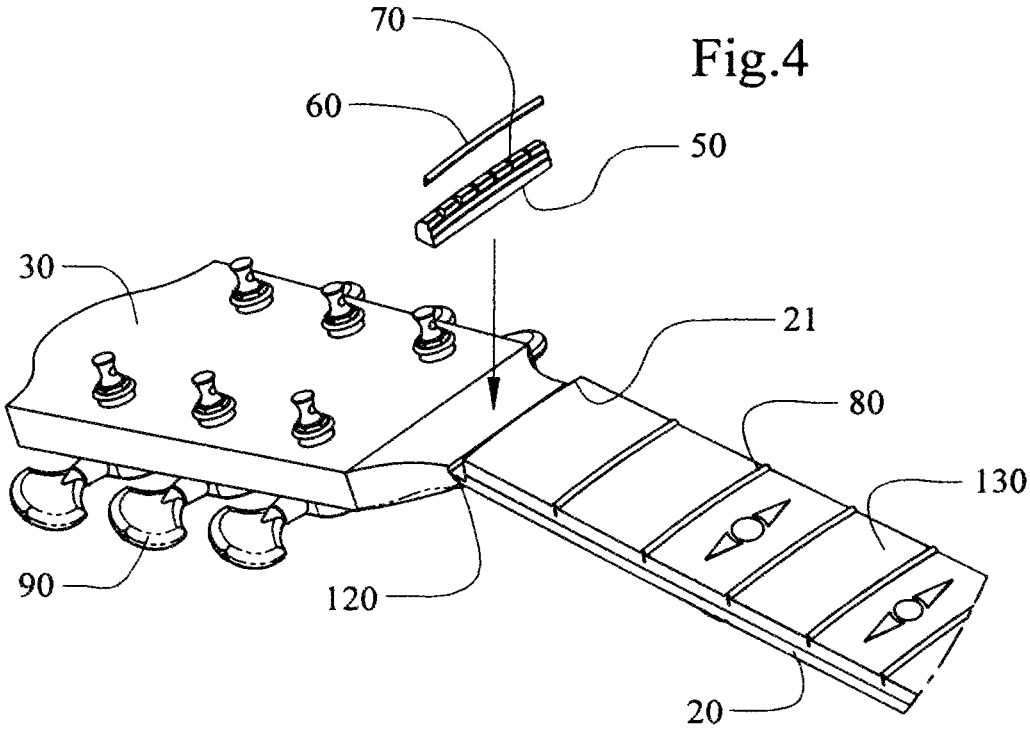
FIG. 4 is another exploded view of the zero glide components of FIG. 2.

FIG. 1 is a top perspective view of a guitar 10 with the zero glide nut and fret installed on the neck 20. FIG. 2 is an enlarged view of the zero glide nut and fret installation of FIG. 1, with the zero glide nut 50 and fret 60 installed on the guitar neck 20 near the guitar head 30. FIG. 3 is an exploded view of the zero glide nut 50 and fret 60 components of FIG. 2 separated from the guitar 10. FIG. 4 is another exploded view of the zero glide nut 50 and fret 60 components of FIG. 2 separated from the guitar 10.

Referring to FIGS. 1-4, the novel zero glide nut 50 and fret 60 can be mounted in the nut slot cut out 120 of the guitar neck 20. The novel zero glide nut 50 and fret 60 components allow for the guitar string 40 (controlled over guitar fingerboard 130) to slide in and out of the string slot 70, where the string 40 can ride on guitar fret(s) 80. The guitar head 30 can have a rotatable tuner control 90 to adjust 100 string motion.

Figure 5:
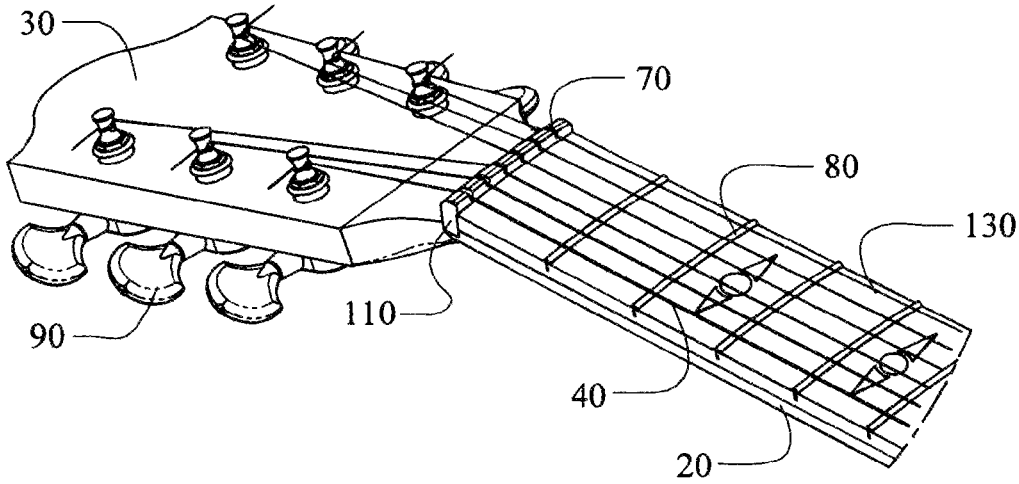
Fig.5 (PRIOR ART)
FIG. 5 is a prior art view of a standard guitar nut installation.
Figure 6:
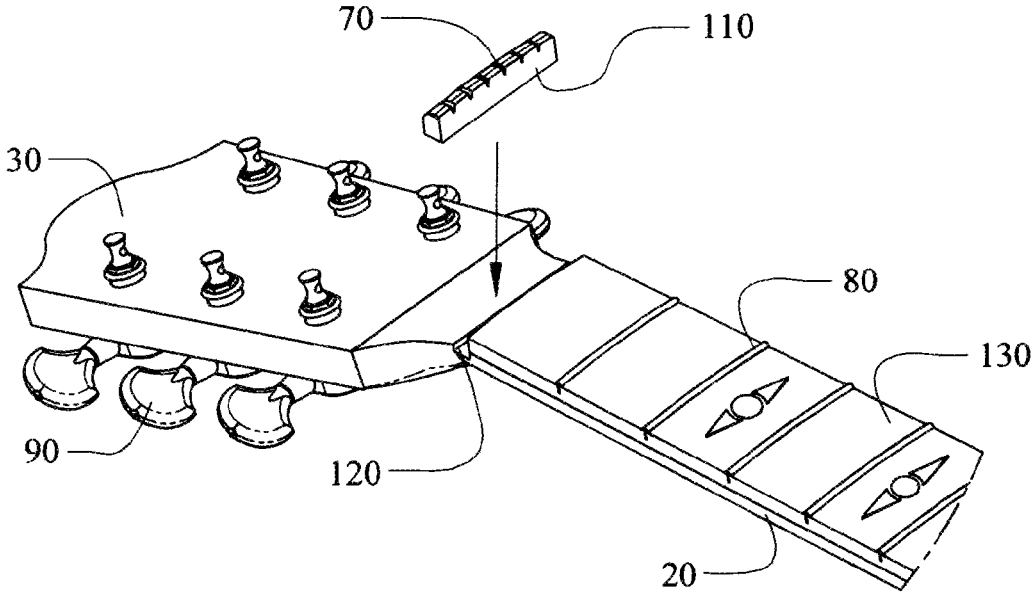
Fig.6 (PRIOR ART)
FIG. 6 is an exploded view of the standard guitar nut of FIG. 5.
Figure 7:
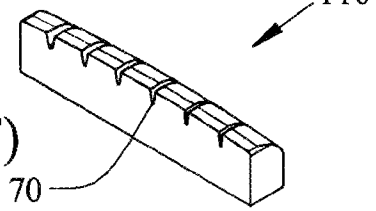
Fig.7 (PRIOR ART)
FIG. 7 is a rear perspective view of the standard guitar nut of FIG. 5.
Figure 8:
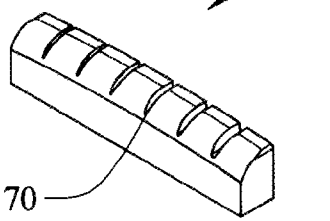
Fig.8 (PRIOR ART)
FIG. 8 is a front perspective view of the standard guitar nut of FIG. 5.
Figure 13:
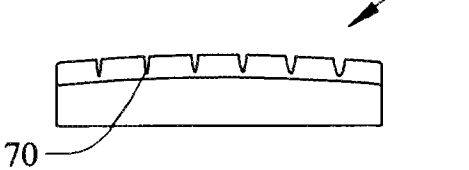
Fig.13 (PRIOR ART)
FIG. 13 is a front view of the standard guitar nut of FIG. 5.
Figure 12:
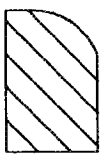
Fig.12 (PRIOR ART)
FIG. 12 is a cross-sectional view of the nut of FIG. 9 along arrow 12X.
Figure 10:
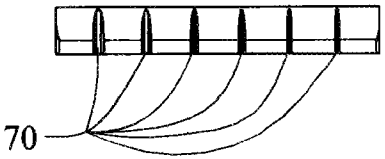
Fig.10 (PRIOR ART)
FIG. 10 is a top view of the standard guitar nut of FIG. 5.
Figure 9:
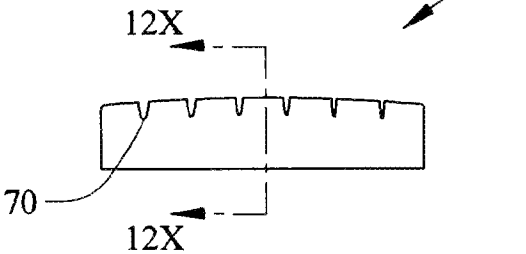
Fig.9 (PRIOR ART)
FIG. 9 is a rear view of the standard guitar nut of FIG. 5.
Figure 11:
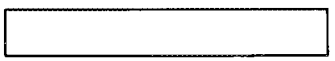
Fig.11 (PRIOR ART)
FIG. 11 is a bottom view of the standard guitar nut of FIG. 5.

FIG. 5 is a prior art view of a standard guitar nut 110 with slots 70 installed in a nut slot cut out 120 of a guitar neck 20. FIG. 6 is an exploded view of the standard guitar nut 110 of FIG. 5. FIG. 7 is a rear perspective view of the standard guitar nut 110 of FIG. 5. FIG. 8 is a front perspective view of the standard guitar nut 110 with slot(s) 70 of FIG. 5. FIG. 9 is a rear view of the standard guitar nut 110 of FIG. 5. FIG. 10 is a top view of the standard guitar nut 110 of FIG. 5. FIG. 11 is a bottom view of the standard guitar nut 110 of FIG. 5. FIG. 12 is a cross-sectional view of the nut 110 of FIG. 9 along arrow 12X. FIG. 13 is a front view of the standard guitar nut 110 of FIG. 5.

Figure 15:
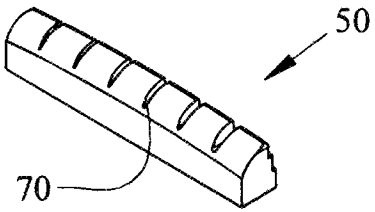
FIG. 15 is a front perspective of the zero glide guitar nut of FIG. 14.
Figure 14:
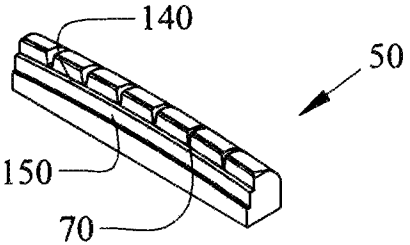
FIG. 14 is a rear perspective of the novel zero glide guitar nut used with the guitar of FIGS. 1-4.
Figure 17:
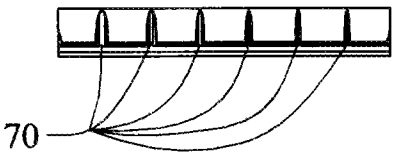
FIG. 17 is a top view of the zero glide guitar nut of FIG. 14.
Figure 19:
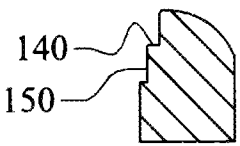
FIG. 19 is a cross-sectional view of the zero glide nut of FIG. 16 along arrow 19X.
Figure 16:
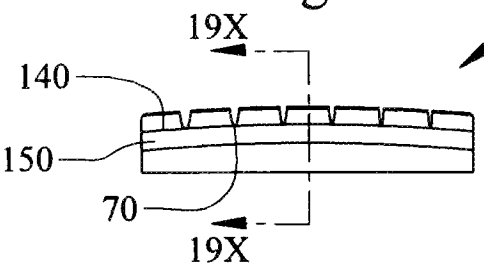
FIG. 16 is a rear view of the zero glide guitar nut of FIG. 14.
Figure 20:
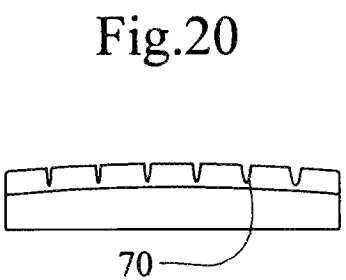
FIG. 20 is a front view of the zero glide guitar nut of FIG. 14.
Figure 18:
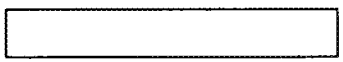
FIG. 18 is a bottom view of the zero glide guitar nut of FIG. 14.

FIG. 14 is a rear perspective of the novel zero glide guitar nut 50 used with the guitar of FIGS. 1-4. FIG. 15 is a front perspective of the zero glide guitar nut 50 of FIG. 14. FIG. 16 is a rear view of the zero glide guitar nut 50 of FIG. 14. FIG. 17 is a top view of the zero glide guitar nut 50 of FIG. 14. FIG. 18 is a bottom view of the zero glide guitar nut 50 of FIG. 14. FIG. 19 is a cross-sectional view of the zero glide nut 50 of FIG. 16 along arrow 19X. FIG. 20 is a front view of the zero glide guitar nut 50 of FIG. 14.

Referring to FIGS. 14-20, the novel zero glide nut 50 can be made of materials, such as but not limited to bone, plastic, and the like. Across an upper top edge of the nut can be a plurality of triangular slots 70 each generally equally spaced apart from one another. On the upper edge of the front of the nut 50 can be a convex curved surface. On the back of the nut 50 can be a two step cut-out 140, 150. The cut-out 140, can be a relief cut on the zero glide nut 50 for zero glide fret head clearance. The cut-out 150 can be a relief cut on the zero glide nut 50 for zero glide fret tang clearance.

Figure 21:
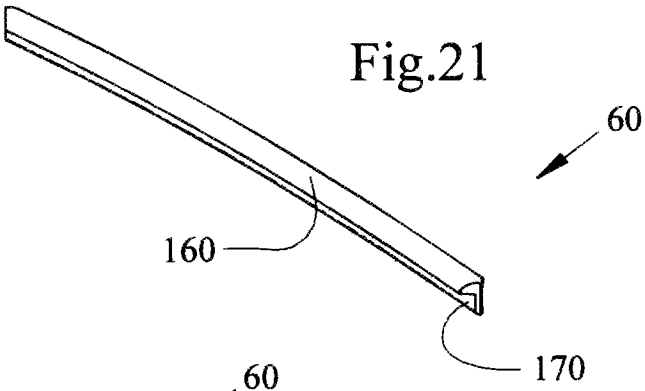
FIG. 21 is a front perspective view of the novel zero glide fret used with the guitar of FIGS. 1-4.
Figure 23:
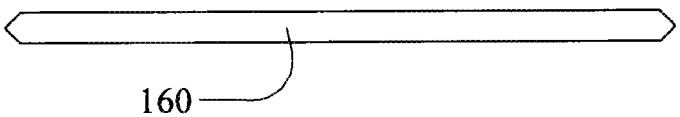
FIG. 23 is a front view of the zero glide fret of FIG. 21.
Figure 24:
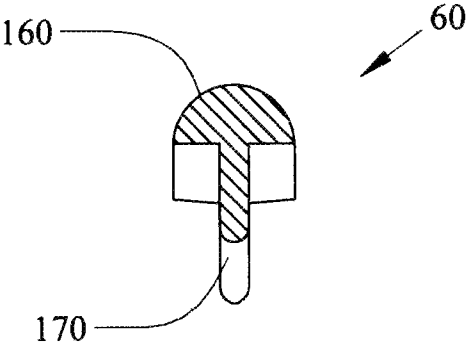
FIG. 24 is a cross-sectional view of the zero glide fret of FIG. 22 along arrow 24X.
Figure 22:
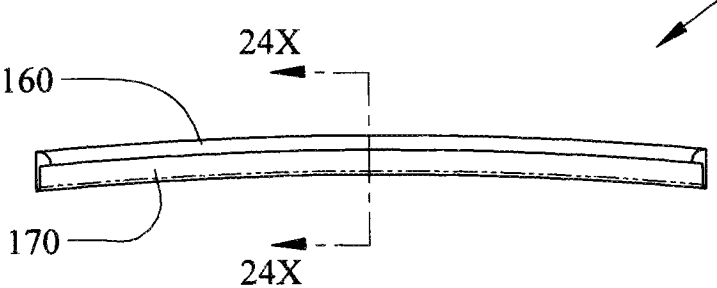
FIG. 22 is a top view of the novel zero glide fret of FIG. 21.

FIG. 21 is a front perspective view of the novel zero glide fret 60 used with the guitar 10 of FIGS. 1-4. FIG. 22 is a top view of the novel zero glide fret 60 of FIG. 21. FIG. 23 is a front view of the zero glide fret 60 of FIG. 21. FIG. 24 is a cross-sectional view of the zero glide fret 60 of FIG. 22 along arrow 24X.

Referring to FIGS. 21-24, the zero glide fret 60 can include a fret head portion 160 having a domed mushroom type shape with a fret tang stem type portion 170.

Figure 25:
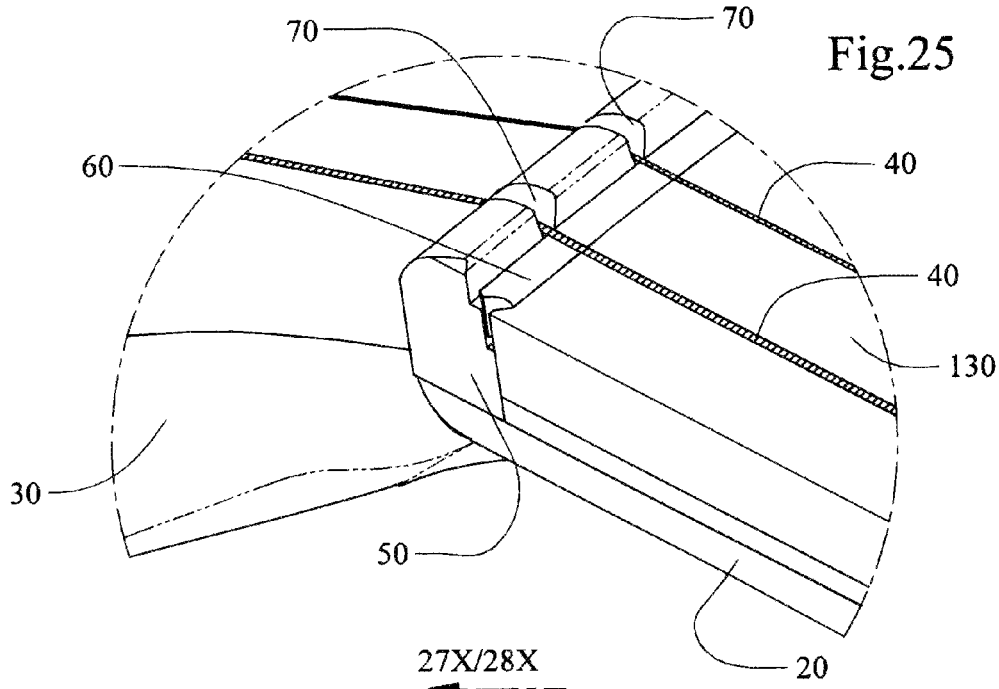
FIG. 25 is an enlarged perspective view of the zero glide nut and fret installed.
Figure 26:
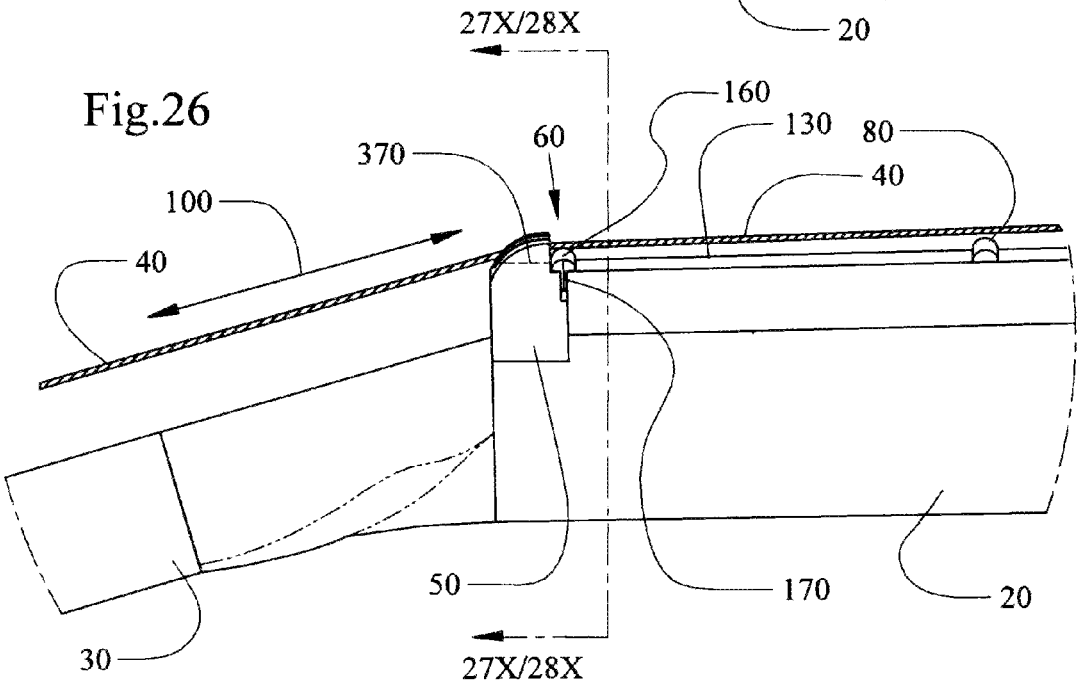
FIG. 26. is a side view of the zero glide guitar nut and fret installation of FIG. 25.
Figure 27:
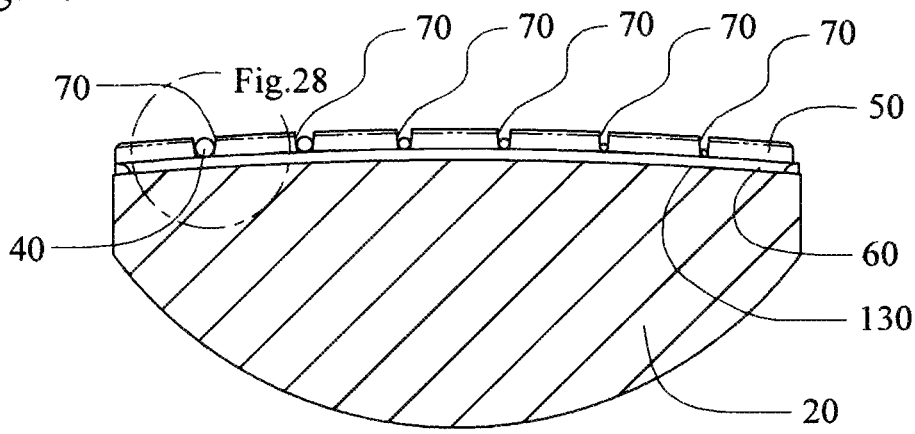
FIG. 27 is a guitar head end view of the zero glide guitar nut and fret installation of FIG. 26 along arrows 27X/28X showing string to zero glide fret contact.
Figure 28:
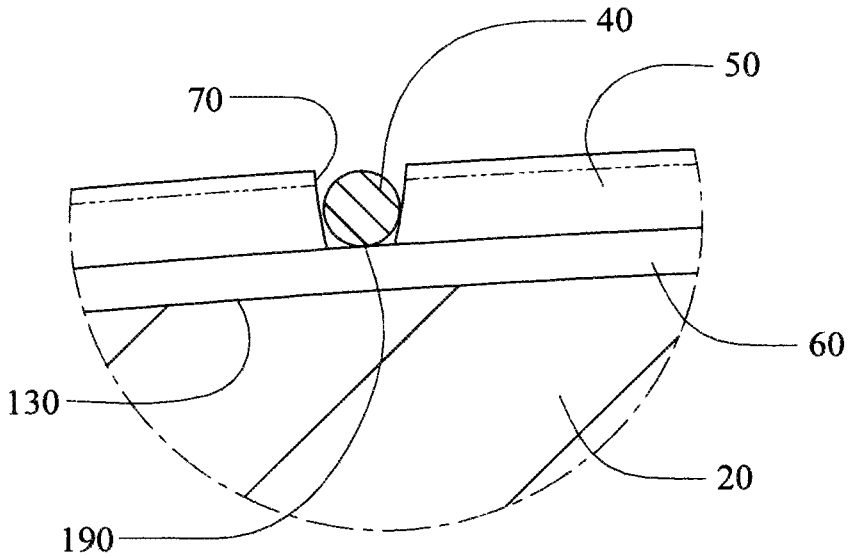
FIG. 28 is an enlarged view of FIG. 27 showing string to zero glide fret contact

FIG. 25 is an enlarged perspective view of the zero glide nut 50 and fret 60 installed on the guitar of FIGS. 1-4. FIG. 26. is a side view of the zero glide guitar nut 50 and fret 60 installation of FIG. 25. FIG. 27 is a guitar head end view of the zero glide guitar nut 50 and fret 60 installation of FIG. 26 along arrows 27X/28X showing string 40 to zero glide fret 60 contact. FIG. 28 is an enlarged view of FIG. 27 showing string 40 to zero glide fret 60 contact.

Referring to FIGS. 1-4 and 14-26, the zero glide nut 40 fits into nut slot cut out 120 on the guitar neck 20, with the fret tang portion 170 sitting on step 150 and one side edge of dome top head 160 sitting on step 140 with the opposite dome head edge 160 sitting on guitar neck edge 21 adjacent to cut out 120. The width of the novel zero glide nut 40 from front to back does not change since the fret does not extend rearwardly from the back of the zero glide nut 40. The head 160 of the fret 60 can extend rearwardly from the zero glide nut 40 with installed fret 60. The fret 60 can be permanently mounted into the two step cut-out 140, 150 by adhesive such, as but not limited to glue, cement, and the like. The fret 60 can be formed from a metal material, plastic, and the like. The combined zero glide nut 50 with installed fret 60, can fit into the same space as a prior art nut 110 on the stringed instrument. Thus, the combined zero glide nut 50 with installed fret 60 can easily replace the existing single nut 110 when desired.

The top of dome head 160 of the installed fret 60 allows for the string(s) 40 to be raised from the bottom and side edges of the string slot(s) 70 in the zero 20 glide nut 50 so that no side and button of the slot 370 rubbing of the string(s) 40 occurs. Additionally, the slots 70 are not wearing out which also happens in the prior art. The string(s) 40 contacts a top point 190 of the zero glide fret 60 and not the bottom of the slot(s) 70. At most the string(s) 40 lightly touch the sides.

Figure 29:
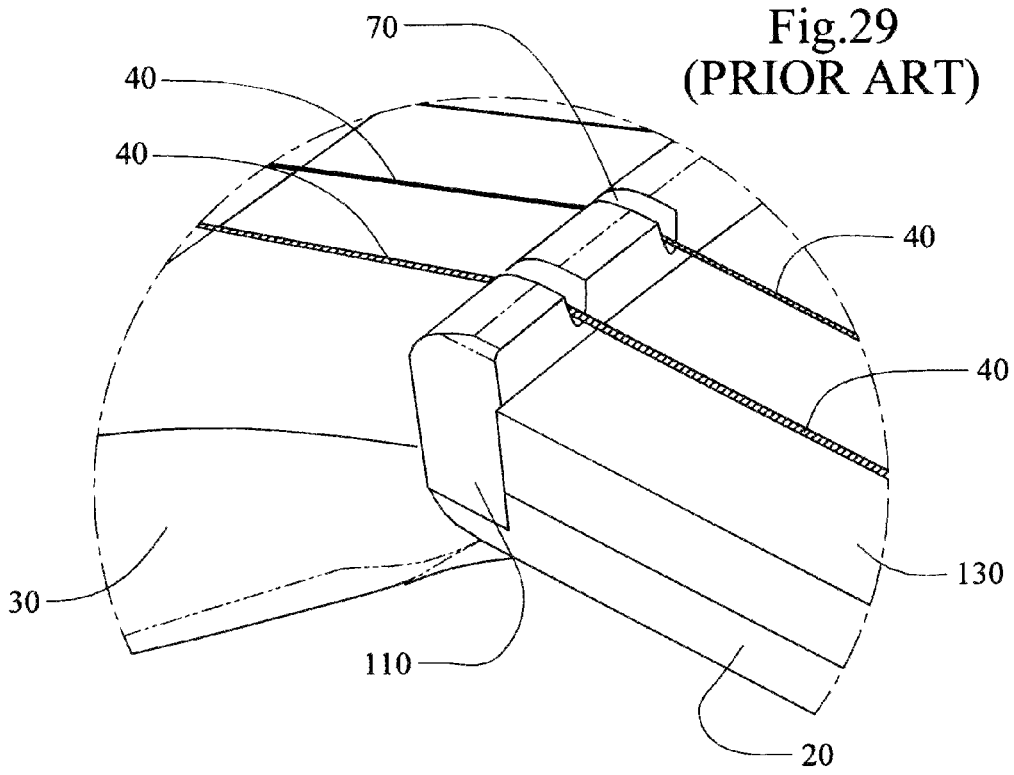
Fig.29 (PRIOR ART)
FIG. 29 is an enlarged prior art perspective view of a standard guitar nut installation.
Figure 30:
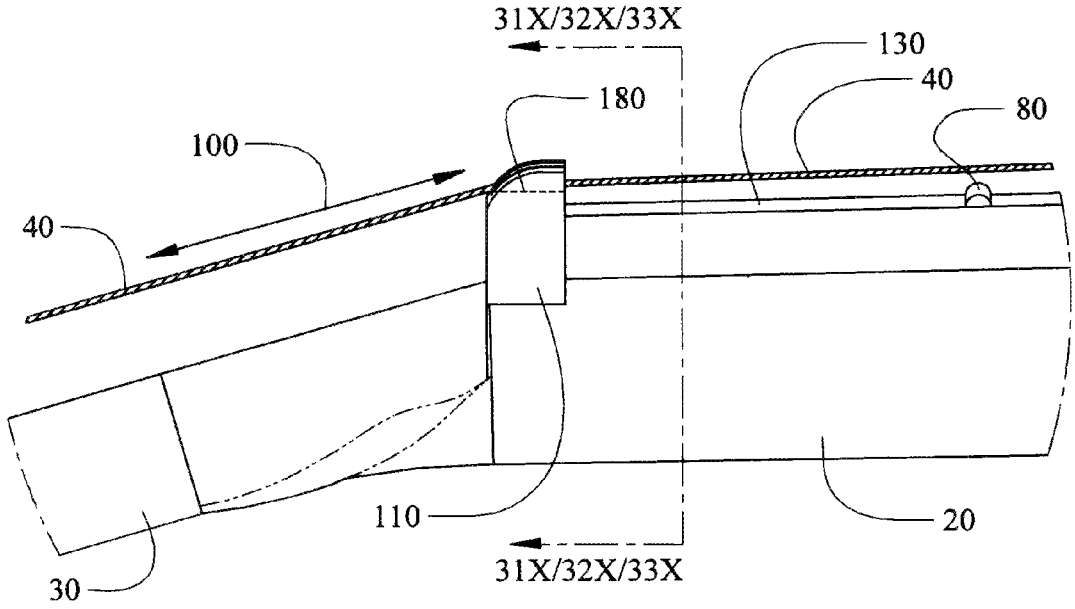
Fig.30 (PRIOR ART)
FIG. 30 is a side view of the standard guitar nut installation of FIG. 29.
Figure 31:
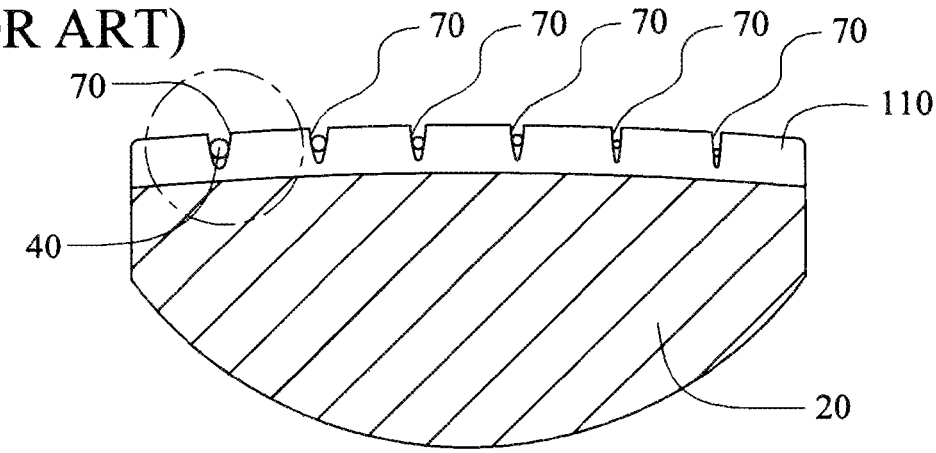
Fig.31 (PRIOR ART)
FIG. 31 is a guitar head end view of the standard guitar nut installation of FIG. 30 along arrows 31X/32X/33X.
Figure 32:
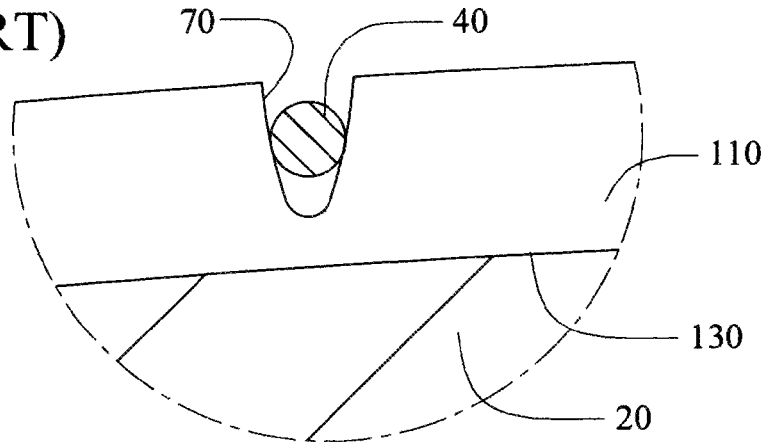
Fig.32 (PRIOR ART)
FIG. 32 is an enlarged view of FIG. 31 showing string rubbing into a nut slot.
Figure 33:
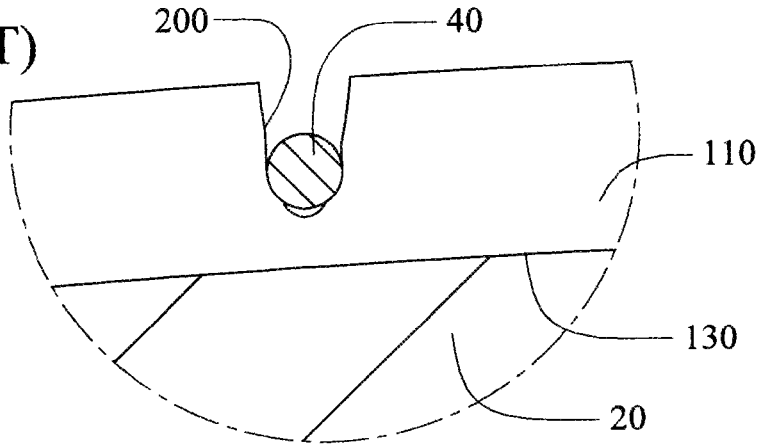
Fig.33 (PRIOR ART)
FIG. 33 is another enlarged view of FIG. 31 showing string movement while playing and tuning has worn the nut slot which will result in the string binding in the nut.

FIG. 29 is an enlarged prior art perspective view of a standard guitar nut 110 installation in a guitar 10. FIG. 30 is a side view of the standard guitar nut 110 installation of FIG. 29. The standard guitar nut string slot 70 wears out 180 as a result of string 40 motion imparted when tuning and playing the guitar 10. FIG. 31 is a guitar head end view of the standard guitar nut installation of FIG. 30 along arrows 31X/32X/33X. FIG. 32 is an enlarged view of FIG. 31 showing string 40 rubbing into a nut slot 70. FIG. 33 is another enlarged view of FIG. 31 showing string 40 movement while playing and tuning has worn the nut slot 200 which will result in the string 40 binding in the nut 110. The constant rubbing against slot 70 wall sides and bottoms effects the play and sound of the guitar 10.

Banjo Installation

FIG. 34 is a top perspective view of a banjo 210 with the novel zero glide installed on the banjo neck 220 adjacent to the head 230. This installation includes an option feature which hides the ends of the fret tang.

FIG. 35 is an enlarged view of the zero glide nut banjo installation of FIG. 34 with novel zero glide nut 270 having string slots 300 and fret 280. FIG. 35 shows the banjo head 230 with string(s) 240 controlled by tuner 250. The string(s) 240 can be supported by zero glide fret(s) 280 and the string (s) 240 controlled by the player on banjo fingerboard 290. FIG. 36 is an exploded view of the zero glide nut 270 and fret 280 and banjo 210 of FIG. 35. FIG. 37 is another exploded view of zero glide nut 270 and fret 280 and banjo 210 of FIG. 36.

Figure 38:
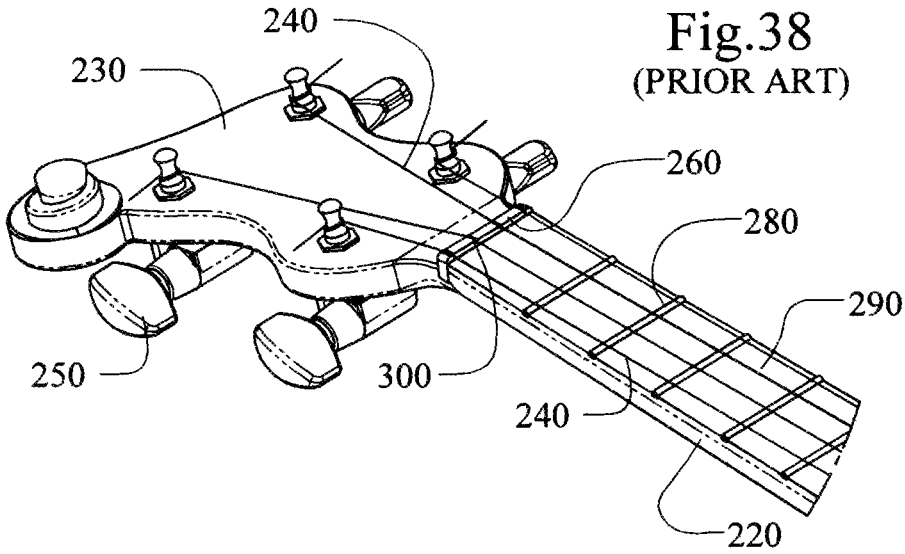
Fig.38 (PRIOR ART)
FIG. 38 is a top perspective prior art view of a banjo with standard nut installed.
Figure 39:
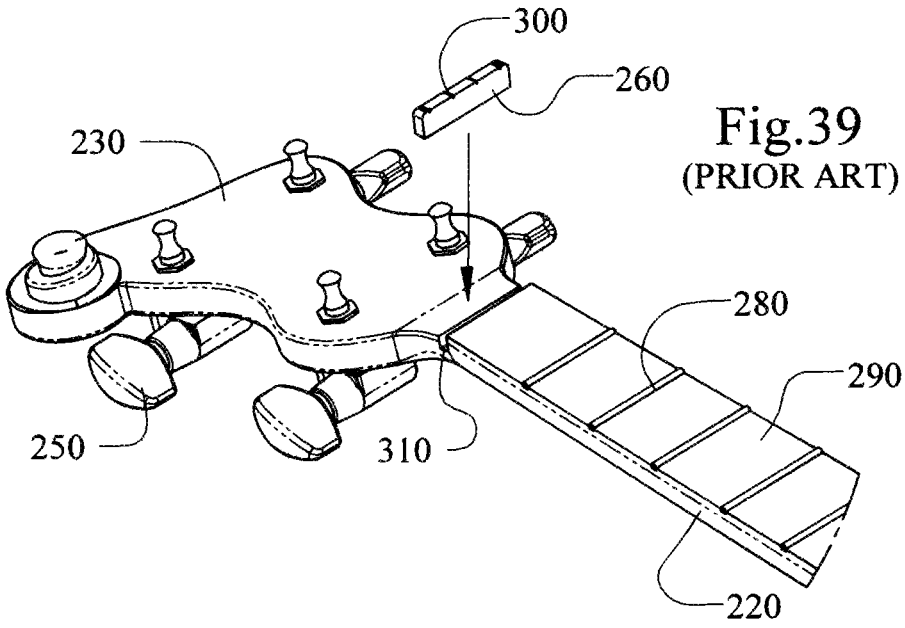
Fig.39 (PRIOR ART)
FIG. 39 is an exploded view of the banjo with standard nut of FIG. 38.

FIG. 38 is a top perspective prior art view of a banjo with standard nut 300 installed. FIG. 39 is an exploded view of the banjo with standard nut 260 with string slot(s) 300 of FIG. 38 separated from the nut slot cut out 310 of the banjo neck 220.

Figure 40:
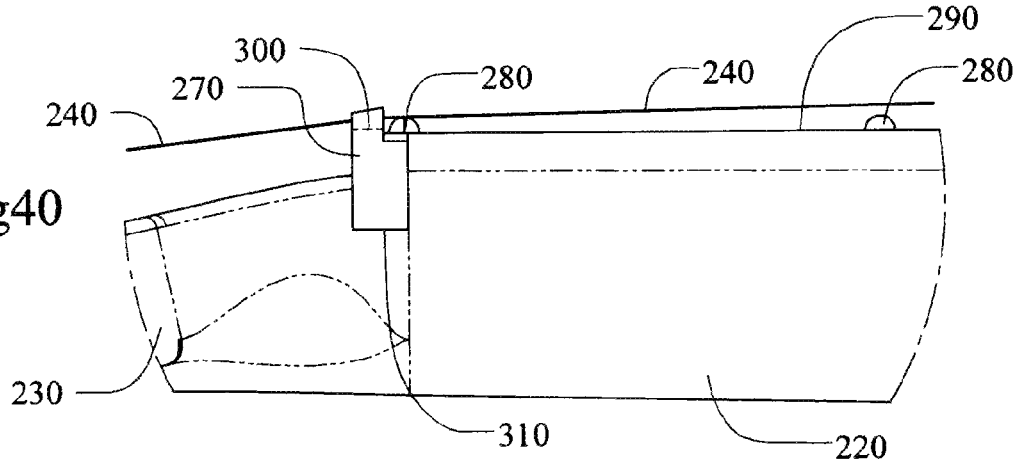
FIG. 40 is a side view of the banjo installed zero glide nut and fret of FIG. 35.
Figure 41:
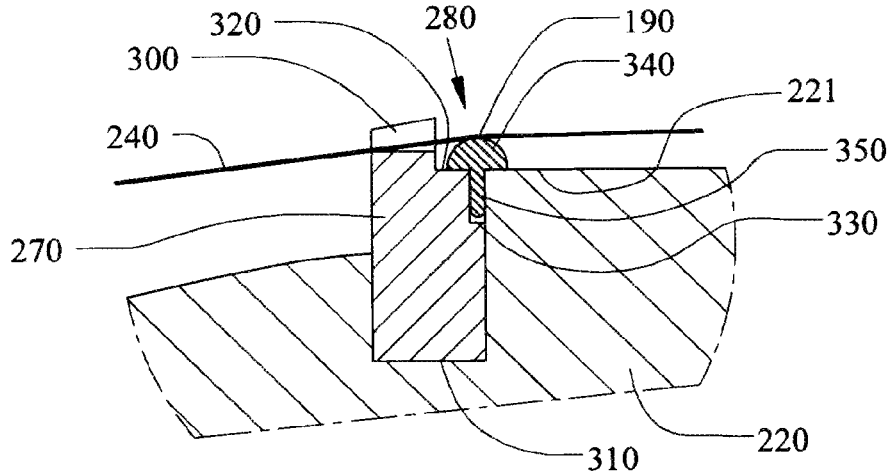
FIG. 41 is an enlarged side view of the installed zero glide nut and fret of FIG. 40. The hidden tang can be seen.

FIG. 40 is a side view of the banjo installed zero glide nut 270 and fret 280 of FIG. 35. Here, the option side wall feature can hide the ends of the fret tang 350. FIG. 41 is an enlarged side view of the installed zero glide nut 270 and fret 280 of FIG. 40.

Similar to the previous embodiment the zero glide nut 270 fits into nut slot cut out 310 on the banjo neck 220, with the fret tang portion 350 sitting on blind relief cut 330 on zero glide banjo nut 270 to clear fret tang 350 and hide ends of the tang 350. One side edge of dome (mushroom shaped) top fret head 340 sitting on relief nut step 320 on the zero glide nut 270. The opposite dome head edge 340 sitting on the banjo neck edge 221 adjacent to cut out 310. The width of the novel zero glide nut 270 from front to back does not change since the fret 280 does not extend rearwardly from the back of the zero glide nut 270. The head 340 of the fret 280 can extend rearwardly from the zero glide nut 270 with installed fret 280. The fret 280 can be permanently mounted into the two step cut-outs by adhesive such, as but not limited to glue, cement, and the like. The fret 280 can be formed from a metal material, plastic, and the like. The combined zero glide nut 270 with installed fret 280, can fit into the same space as a prior art nut 260 on the stringed instrument. Thus, the combined zero glide nut 270 with installed fret 280 can easily replace the existing single nut 260 when desired.

Figure 42:
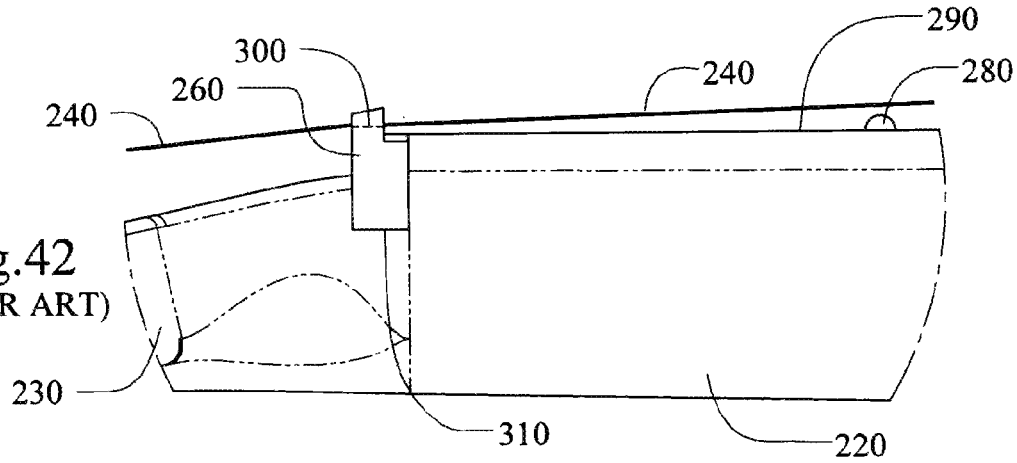
Fig.42 (PRIOR ART)
FIG. 42 is a prior art side view of the standard banjo nut installation of FIG. 38.
Figure 44:
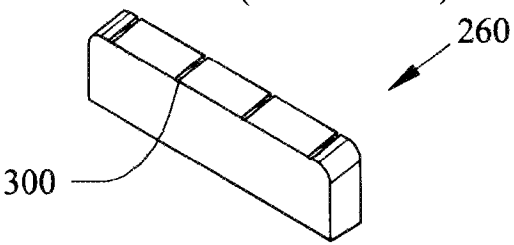
Fig.44 (PRIOR ART)
FIG. 44 is a front perspective view of the standard banjo nut of FIG. 43.
Figure 43:
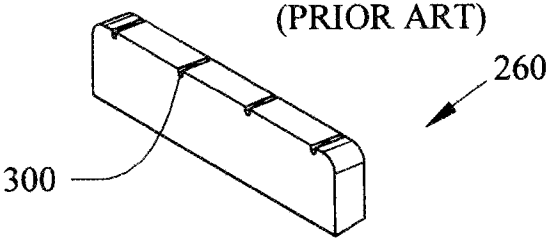
Fig.43 (PRIOR ART)
FIG. 43 is a rear perspective view of a standard banjo nut from FIG. 38.
Figure 46:
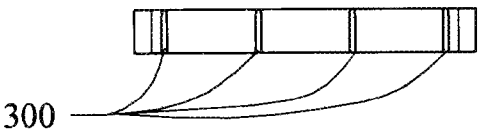
Fig.46 (PRIOR ART)
FIG. 46 is a top view of the standard banjo nut of FIG. 43.
Figure 49:
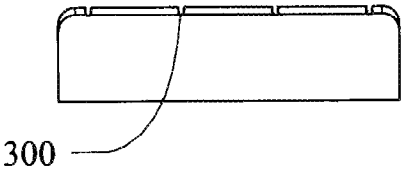
Fig.49 (PRIOR ART)
FIG. 49 is a front view of the standard banjo nut of FIG. 43.
Figure 48:
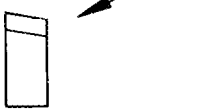
Fig.48 (PRIOR ART)
FIG. 48 is a side view of the standard banjo nut of FIG. 43.
Figure 45:
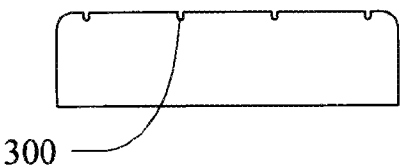
Fig.45 (PRIOR ART)
FIG. 45 is a rear view of the standard banjo nut of FIG. 43.
Figure 47:
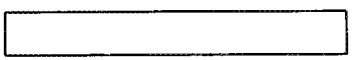
Fig.47 (PRIOR ART)
FIG. 47 is a bottom view of the standard banjo nut of FIG. 43.

FIG. 42 is a prior art side view of the standard banjo nut 260 installation of FIG. 38. FIG. 43 is a rear perspective view of a standard banjo nut 260 with slot(s) 300 from FIG. 38. FIG. 44 is a front perspective view of the standard banjo nut 260 of FIG. 43. FIG. 45 is a rear view of the standard banjo nut 260 of FIG. 43. FIG. 46 is a top view of the standard banjo nut 260 of FIG. 43. FIG. 47 is a bottom view of the standard banjo nut 260 of FIG. 43. FIG. 48 is a side view of the standard banjo nut 260 of FIG. 43. FIG. 49 is a front view of the standard banjo nut 260 of FIG. 43.

Referring to FIGS. 42-49, the prior art banjo nut 260 has similar problems to those described above in the standard guitar nut.

Figure 51:
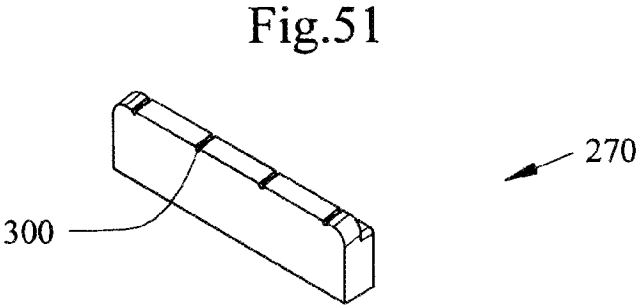
FIG. 51 is a front perspective view of the zero glide banjo nut of FIG. 50.
Figure 50:
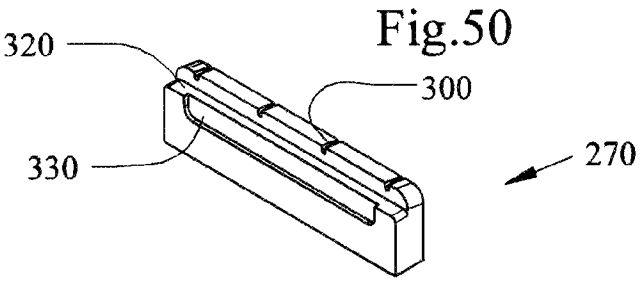
FIG. 50 is a rear perspective view of the zero glide banjo nut of FIG. 35.
Figure 53:
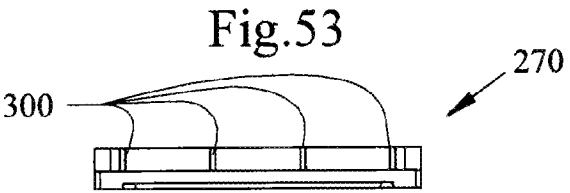
FIG. 53 is a top view of the zero glide banjo nut of FIG. 50.
Figure 56:
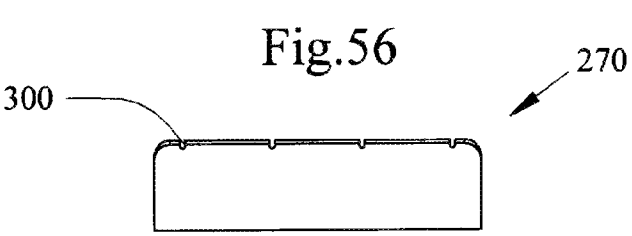
FIG. 56 is a front view of the zero glide banjo nut of FIG. 50.
Figure 55:
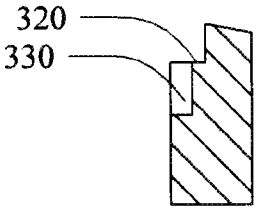
FIG. 55 is a cross-sectional view of the zero glide nut of FIG. 52 along arrow 54X
Figure 52:
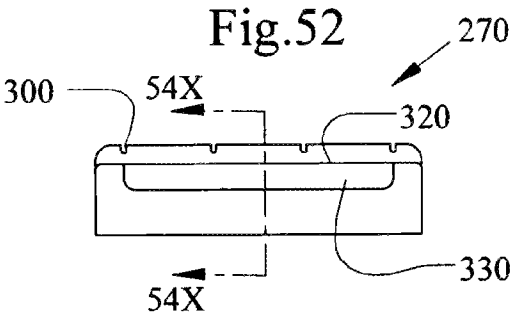
FIG. 52 is a rear view of the zero glide banjo nut of FIG. 50.
Figure 54:
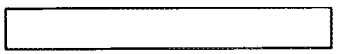
FIG. 54 is a bottom view of the zero glide banjo nut of FIG. 50.

FIG. 50 is a rear perspective view of the zero glide banjo nut 270 of FIG. 35 that is used with the banjo. FIG. 51 is a front perspective view of the zero glide banjo nut 270 of FIG. 50. FIG. 52 is a rear view of the zero glide banjo nut 270 of FIG. 50. FIG. 53 is a top view of the zero glide banjo nut 270 of FIG. 50. FIG. 54 is a bottom view of the zero glide banjo nut 270 of FIG. 50. FIG. 55 is a cross-sectional view of the zero glide nut 270 of FIG. 52 along arrow 54X FIG. 56 is a front view of the zero glide banjo nut 270 of FIG. 50.

Referring to FIGS. 50-56, the zero glide banjo nut 270 can include two steps 320, 330. The cut 330 can have closed sides so as to hide ends of the fret tang 350.

Figure 57:
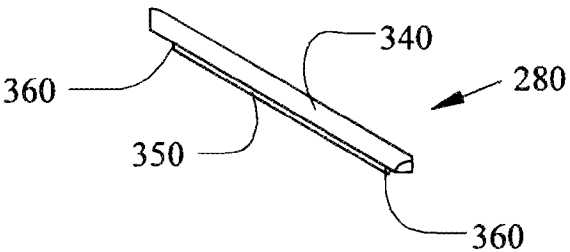
FIG. 57 is a front perspective view of the zero glide banjo fret of FIG. 35.
Figure 59:
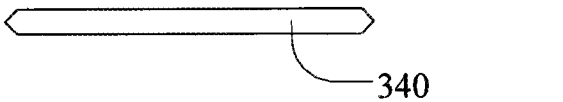
FIG. 59 is a front view of the zero glide banjo fret of FIG. 57.
Figure 60:
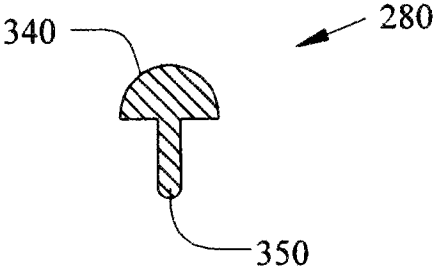
FIG. 60 is a cross-sectional view of the zero glide fret of FIG. 58 along arrow 60X.
Figure 58:
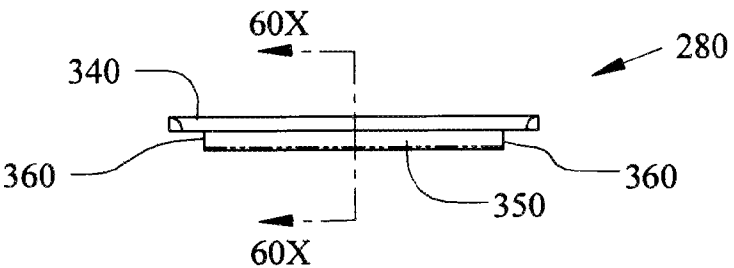
FIG. 58 is a top view of the zero glide banjo fret of FIG. 57.

FIG. 57 is a front perspective view of the zero glide banjo fret 280 of FIG. 35. FIG. 58 is a top view of the zero glide banjo fret 280 of FIG. 57. FIG. 59 is a front view of the zero glide banjo fret 280 of FIG. 57. FIG. 60 is a cross-sectional view of the zero glide fret 280 of FIG. 58 along arrow 60X.

Referring to FIGS. 57-60 the banjo fret 280 can have a dome head (mushroom shaped) 340 and a lower extending tang (stem) 350, with a zero glide fret tang cut back 360 from ends of the fret 280 to conceal in the blind nut cut out relief 330 previously described.

The zero glide nut and fret is easier to install over a conventional nut because the installation on a conventional nut requires expertise to properly adjust the nut slot (such as use a file and an experienced installer to cut it at a proper depth). With the zero glide nut and fret, the slot just needs to be cut before the first step (on the back of the nut), and can by done inexperienced installers. The inexperienced installer only needs to file down to the first step (first ledge) without having to perform detailed measurements.

The invention can be sold in kit forms, where for example a combination of a combined nuts with installed frets along with standard nuts, can be used interchangeably on the same stringed instrument when desired and needed.

Although the preferred embodiment describes the stringed instrument using the invention is preferably a guitar, the invention can be used with other stringed instruments, such as but not limited to violins, mandolins, and the like.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A zero glide nut system for stringed instruments, comprising in combination:

a one piece replacement nut having a front and a back;

a two step cut-out formed in an upper edge along the back of the replacement nut, the two step cut-out having an upper step and a lower step; and a fret with an enlarged head on a stem installed on the two step cut-out on the back of the replacement nut, so that an overhanging portion of the enlarged head sits on the upper step and the stem sits on the bottom step, wherein the combined replacement nut with installed fret is used to replace a standard nut which is mounted in a nut slot cut-out on top of a neck adjacent to a headstock of a stringed instrument, and the front of the replacement nut faces the headstock of the stringed instrument and the back of the replacement nut faces a body of the neck of the stringed instrument.

2. The zero glide nut system of claim 1, wherein the stringed instrument includes:

a guitar.

3. The zero glide nut system of claim 1, wherein the stringed instrument includes:

a banjo.

4. The zero glide nut system of claim 1, wherein the replacement nut includes:

a generally convex curved upper front edge.

5. The zero glide nut system of claim 1, wherein the replacement nut includes:

a plurality of spaced apart string slots along a top of the nut.

6. The zero glide nut system of claim 1, further including:

an adhesive for permanently mounting the fret to the replacement nut.

7. A method of replacing a nut on a stringed instrument with a zero guide nut, comprising the steps of:

providing a stringed instrument with a neck having a standard installed nut, and a plurality of frets, each of which is spaced apart from the standard nut;

forming a one piece replacement nut having a front and a back with a two step cut-out in an upper edge on the back of the nut, the two step cut-out having an upper step and a lower step;

providing a fret with an enlarged head on a stem; installing the fret on the two step cut-out, so that an overhanging portion of the enlarged head sits on the upper step and the stem sits on the bottom step; and replacing the standard installed nut which is mounted in a nut slot cut-out on top of the neck adjacent to a headstock on the stringed instrument with the replacement nut and installed fret, wherein the front of the replacement nut faces the headstock of the stringed instrument and the back of the replacement nut faces a body of the stringed instrument.

8. The method of claim 7, wherein the replacement nut with installed fret includes:

a generally convex curved upper front edge on the replacement nut.

9. The method of claim 7, wherein the replacement nut with installed fret includes:

a plurality of spaced apart string slots along a top of the replacement nut.

10. The method of claim 7, wherein the replacement with installed fret includes:

an adhesive for permanently mounting the fret to the replacement nut.

11. The method of claim 7, further comprising the step of:

providing a guitar as the stringed instrument.

12. The method of claim 7, further comprising the step of:

providing a banjo as the stringed instrument.

13. A zero glide retrofit kit for a stringed instrument, comprising in combination:

a one piece replacement nut having a front and a back;

a two step cut-out formed in an upper edge on the back of the replacement nut, the two step cut-out having an upper step and a lower step; and a fret with an enlarged head on a stem installed on the two step cut-out on the back of the replacement nut, so that an overhanging portion of the enlarged head sits on the upper step and the stem sits on the bottom step, wherein the replacement nut with installed fret is adapted to replace a standard nut which is mounted in a nut slot cut-out on top of a neck adjacent to a headstock of a stringed instrument, and the front of the replacement nut faces the headstock of the stringed instrument and the back of the replacement nut faces a body of the stringed instrument.

* * * * *